US005376762A

United States Patent [19]

Kimberlin

[11] Patent Number: 5,376,762

[45] Date of Patent: Dec. 27, 1994

[54] MUFFLER FOR A FLUID-ACTIVATED, PERCUSSIVE APPARATUS

[75] Inventor: Robert R. Kimberlin, Troutville, Va.

[73] Assignee: Ingersoll-Rand Company, Woodcliff Lake, N.J.

[21] Appl. No.: 169,717

[22] Filed: Dec. 17, 1993

Related U.S. Application Data

[63] Continuation of Ser. No. 952,083, Sep. 28, 1992, abandoned.

[51] Int. Cl.[5] ..... F01N 1/08

[52] U.S. Cl. ..... 181/230

[58] Field of Search ..... 181/205, 211, 215, 230, 181/232, 241, 255, 273, 276

[56] References Cited

U.S. PATENT DOCUMENTS

| | | | |
|---|---|---|---|
| 3,263,770 | 8/1966 | Alm | 181/230 |
| 3,365,022 | 1/1968 | Barber et al. | 181/230 |
| 3,526,293 | 9/1970 | Hayes et al. | 181/230 |
| 3,554,316 | 1/1971 | Judd | 181/230 |
| 3,635,299 | 1/1972 | Hayes | 181/230 |
| 3,814,209 | 6/1974 | Inoue | 181/230 |
| 3,993,159 | 11/1976 | Amador | 181/230 |
| 4,496,023 | 1/1985 | Lindberg et al. | 181/230 X |

FOREIGN PATENT DOCUMENTS 1550499 8/1979 United Kingdom .

*Primary Examiner*—Michael L. Gellner
*Assistant Examiner*—Khanh Dang
*Attorney, Agent, or Firm*—John J. Selko

[57] ABSTRACT

A muffler for a fluid-activated, percussive, impact apparatus includes a hollow, elongated shell, forming a closed exhaust chamber, extending lengthwise along a body of the apparatus, the shell partially encircling the body of the apparatus. The shell is removably attached to the body of the apparatus so that an inlet aperture in the shell coincides with an exhaust port of the apparatus. An adjustable deflector is positioned on the outlet aperture of the shell. The shell is provided from a flexible, plastic material.

14 Claims, 5 Drawing Sheets

MUFFLER FOR A FLUID-ACTIVATED, PERCUSSIVE APPARATUS

This application is a continuation of application Ser. No. 07/952,083, filed Sep. 28, 1992, abandoned.

BACKGROUND OF THE INVENTION

This invention relates generally to a fluid-activated, percussive apparatus, and more particularly to a muffler for a fluid-activated, percussive jackhammer.

Current jackhammers have either an integral muffler/cylinder or a permanently attached muffler. In each of these cases, the muffler is not readily removable, and the operator must partially disassemble the device in order to remove the muffler. In addition, the operator has no control over the direction of the exhaust, which is directed in a fixed direction out of the device.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a muffler that is a hollow, elongated shell forming a closed exhaust chamber, the shell being formed so as to extend lengthwise along a body portion of a percussive apparatus, and to partially encircle the body portion. Inlet and outlet means are provided in the shell for exhaust fluid, and means are provided for removably attaching the shell to the apparatus body.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
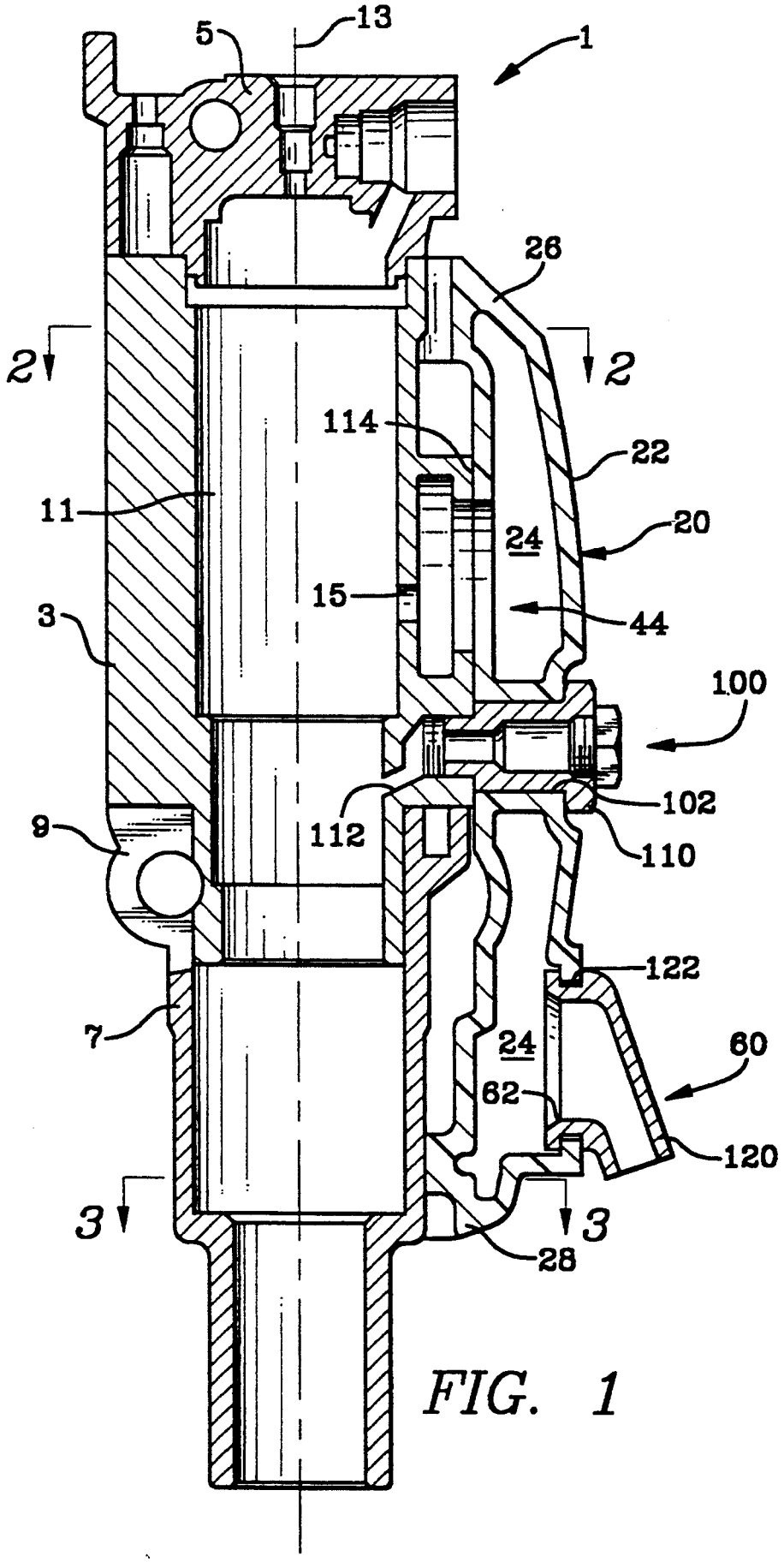
FIG. 1 is a cross sectional side view, with parts removed, of the muffler of this invention on a percussive apparatus.

Referring to the drawings FIG. 1 shows the fluid-activated, percussive apparatus 1 having a body 3, with a backhead 5 at a top end thereof, a fronthead 7 at a bottom end, and an elongated body housing 9 therebetween. Body housing 9 forms a central bore 11 having a longitudinal central axis 13 therethrough for a piston (not shown) to reciprocate along, as is conventional. Housing 9 has an exhaust port 15 for percussive fluid that is exhausted during a stroke cycle, as is well known.

Referring to FIGS. 4–12, muffler 20 is shown to comprise a hollow, elongated shell 22 forming a closed exhaust chamber 24. Shell 22 is adapted and shaped to extend lengthwise along body 9 of apparatus 1 and to partially encircle the body 9, as described more fully hereinafter. Shell 22 includes a top portion 26, a bottom portion 28, a rear wall portion 30, and a front wall portion 32. Front wall portion 32 is curved to form an elongated slot 34 that is adapted to receive body 9 of apparatus 1, whereby body 9 is partially encircled, as described hereinafter. Rear wall portion 30 is spaced from front wall portion 32, in a position such that front wall portion 32 is positioned between rear wall portion 30 and body 9 of apparatus 1. Intermediate wall portions 40 connect rear wall and front wall portions 30 and 32, respectively.

As shown in FIG. 1, inlet means 44 in front wall 32 receives percussive fluid exhausted from apparatus 1. Inlet means 44 includes an aperture 46 (FIG. 7) located in front wall 32 at a position that coincides with an exhaust aperture 15 in body 9. Outlet means 60 in rear wall 32 includes an aperture 62 that permits flow of exhaust percussive fluid out from chamber 24.

Figure 2:
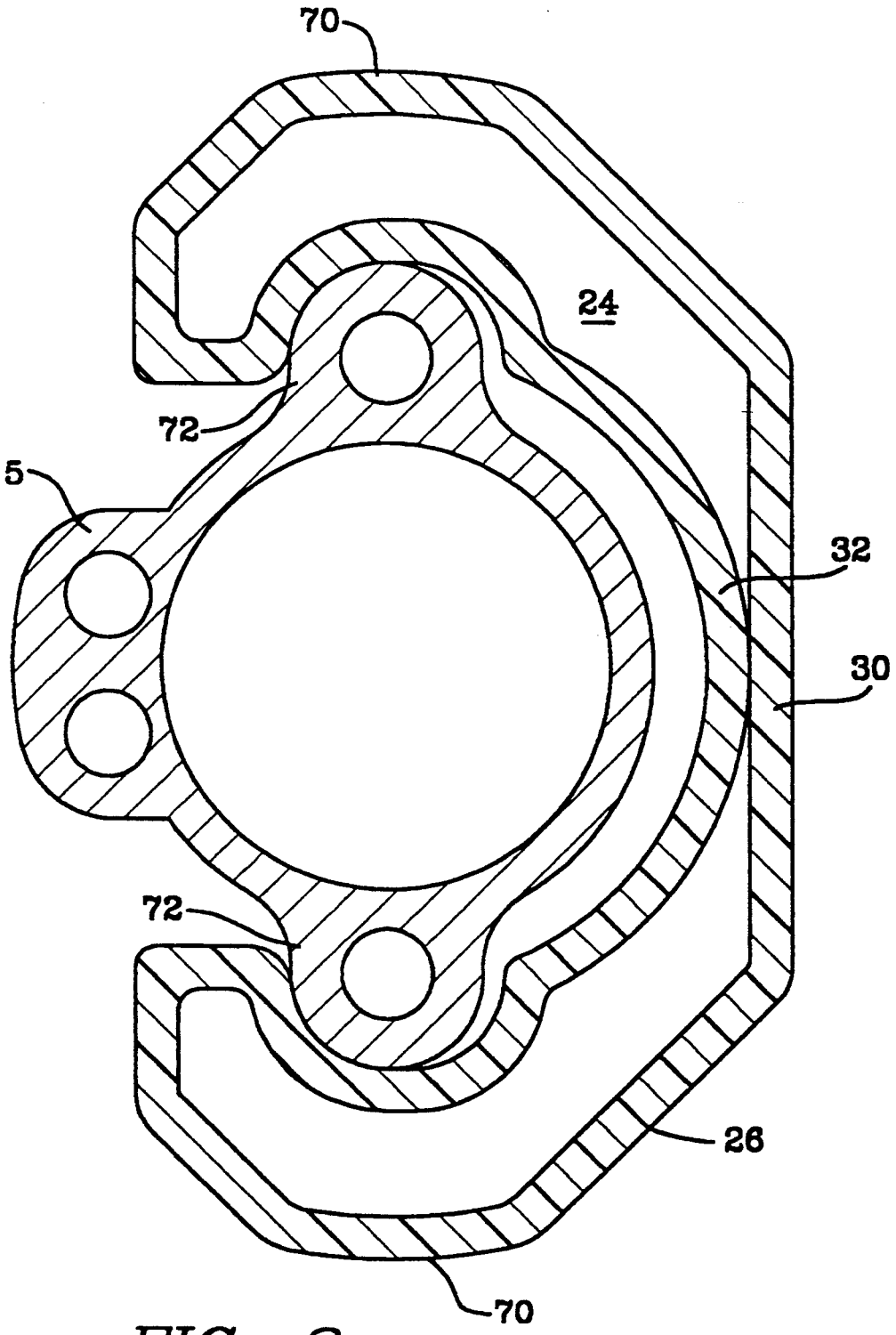
FIG. 2 is a cross sectional view along 2—2 of FIG. 1.
Figure 3:
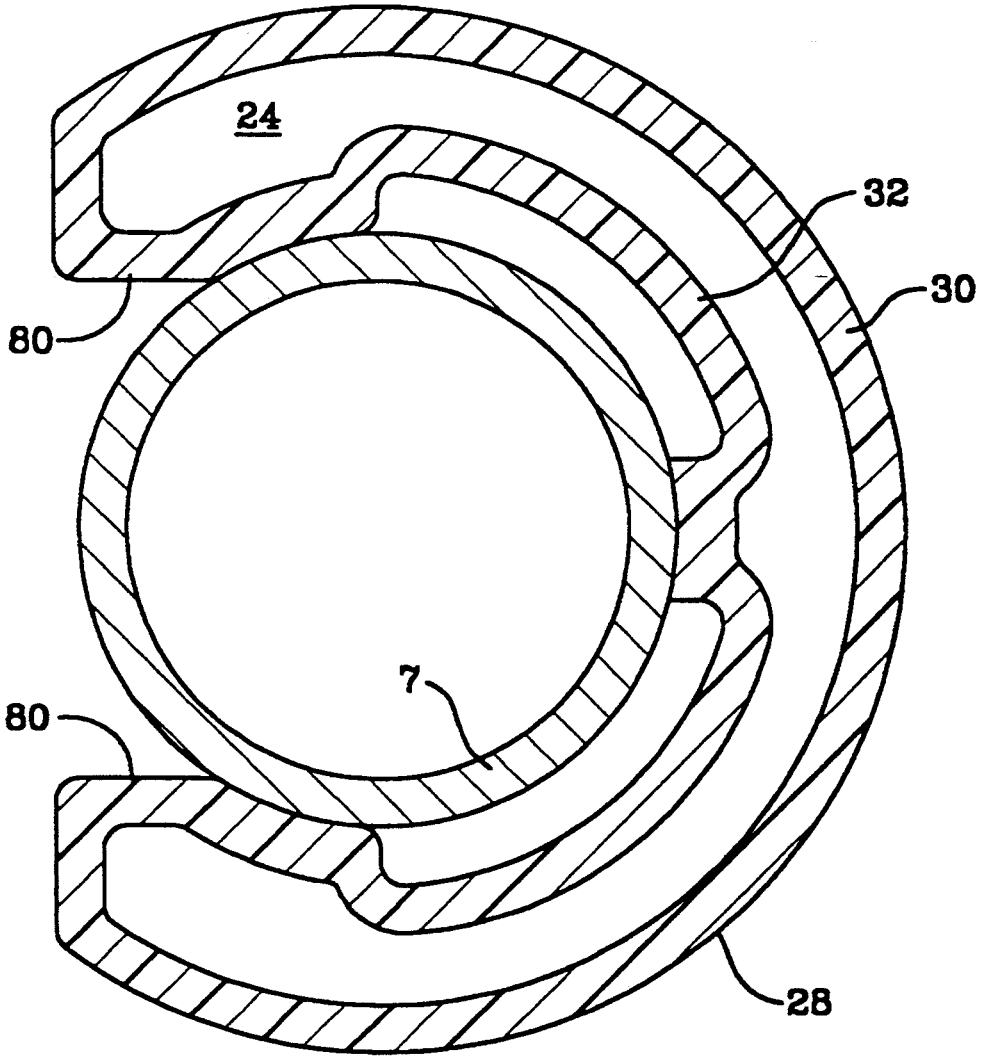
FIG. 3 is a cross sectional view along 3—3 of FIG. 1.
Figure 4:
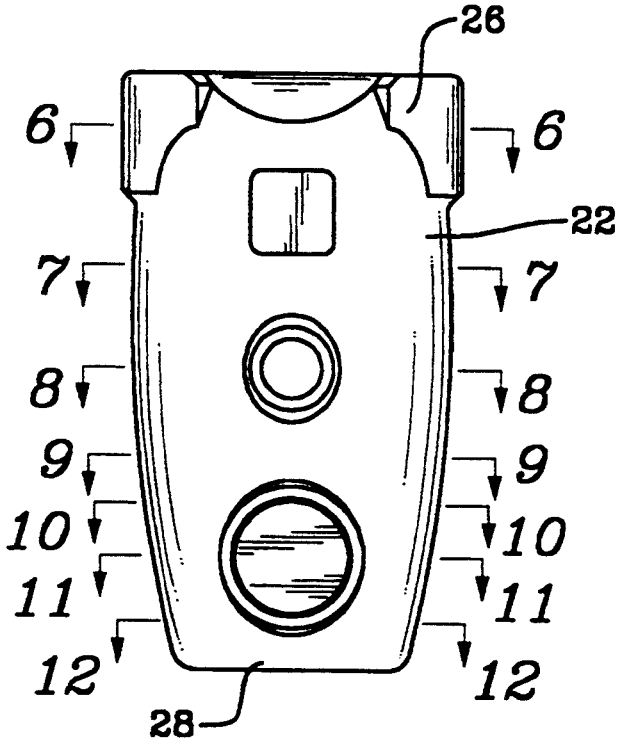
FIG. 4 is a front elevational view of the muffler of this invention.
Figure 5:
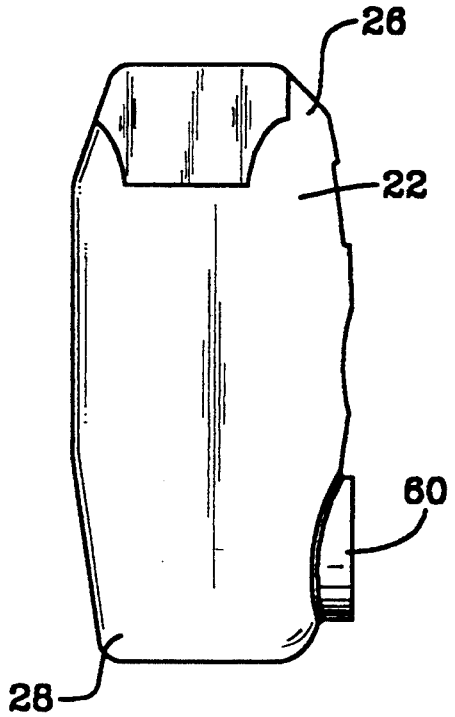
FIG. 5 is a side view of FIG. 4.
Figure 6:
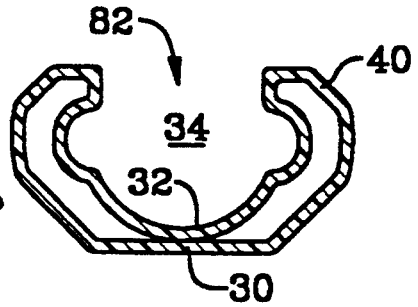
FIG. 6 is a cross sectional view along 6—6 of FIG. 4.
Figure 7:
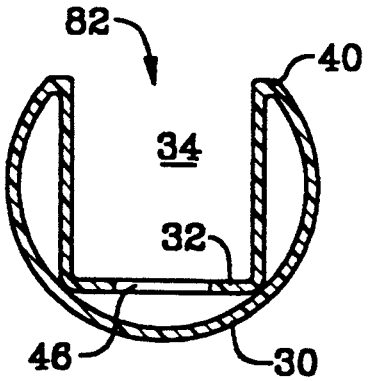
FIG. 7 is a cross sectional view along 7—7 of FIG. 4.

Shell 22 is provided from a flexible material, such as plastic or urethane, so that shell 22 can be elastically deformed by the operator to readily fit around the body 9 of apparatus 1. A first attachment means (FIG. 2) comprises a pair of lugs 70 formed in top portion 26 of shell 22. Lugs 70 are spaced apart and shaped such that they will slide lengthwise over and along body 9, and can also be elastically spread apart over backhead 5 so as to form an interference fit onto backhead 5. Backhead 5 may or may not have protrusions 72 therein that will receive lugs 70 for interference fit.

Because shell 22 is formed from a plastic material, the shape of shell 22, and particularly front surface 32, can be provided by making a mold from backhead 5 and molding the shell 22 by conventional molding methods. Front surface 32 is shaped to generally encircle body 9 of apparatus 1 through an arc of between 180 to 270 degrees, as measured around axis 13, when viewed in a horizontal plan view, as in FIGS. 2,3,6–12.

A second attachment means (FIG. 3) comprises a pair of lugs 80 formed in bottom portion 28 of shell 22. Lugs 80 are spaced apart and shaped such that they will slide lengthwise over and along body 9, and can also be elastically spread apart over fronthead 7 so as to form an interference fit onto fronthead 7. Lugs 70 are spaced apart at top portion 26 in opposing relation, such that between lugs 70 is an opening 82 that faces front surface 32, which opening extends the length of shell 22, as elongated slot 34. Likewise, lugs 80 are also spaced apart at bottom portion 28 in opposing relation, such that between lugs 80 is opening 82 of elongated slot 34. As can be seen in FIGS. 6–12, the profile of front surface 32 can change, as viewed in plan view at various longitudinal positions along axis 13.

Figure 8:
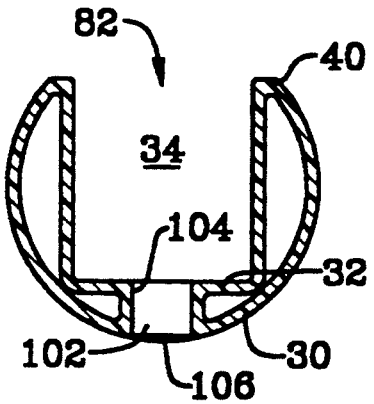
FIG. 8 is a cross sectional view along 8—8 of FIG. 4.
Figure 9:
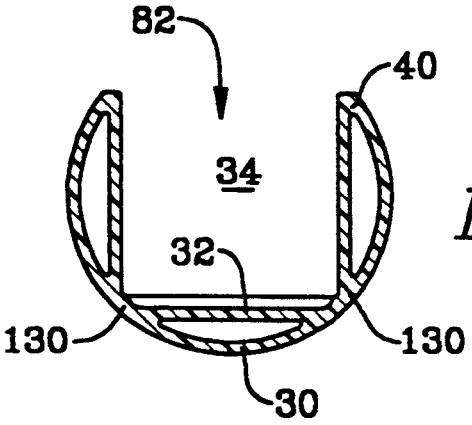
FIG. 9 is a cross sectional view along 9—9 of FIG. 4.
Figure 10:
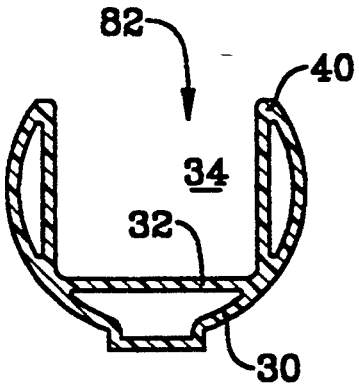
FIG. 10 is a cross sectional view along 10—10 of FIG. 4.
Figure 11:
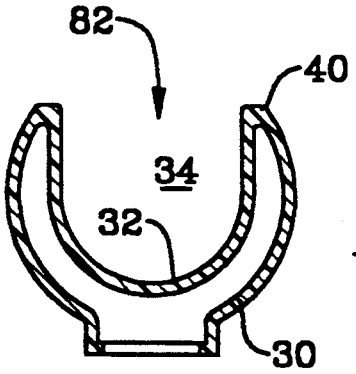
FIG. 11 is a cross sectional view along 11—11 of FIG. 4.
Figure 12:
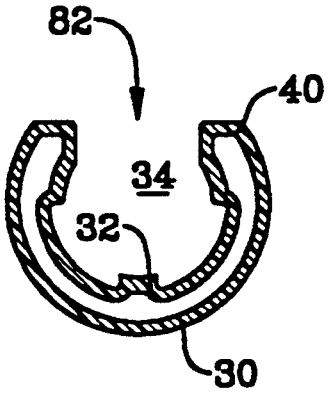
FIG. 12 is a cross sectional view along 12—12 of FIG. 4.

A third attachment means is shown generally as 100 in FIGS. 1 or FIG. 8. Third attachment means 100 is intermediate between the first and second attachments means. Third attachment means 100 includes a passageway 102 extending through shell 22, and includes an aperture 104 in front surface 32 and an aperture 106 in rear surface 30. A fastening member 110 is threadable connected to apparatus body 9 through passageway 102.

Passageway 102 is a fluid conveying passageway, whereby passageway 102 is positioned to coincide with a port 112 in body 9 that receives a fluid lubricant, such as oil, that is inserted by the operator. Fastening member 110 is a hollow plug that is removably threaded into body 9. Plug 110 contacts rear surface 30 to force front surface 32 into fluid sealing contact at contact surface 114 around inlet aperture 46, thereby holding shell 22 against body 9. Thus, it can be understood that shell 22 is attached to body 9 by two flexible interference fits and by a fit that is removable, but more firmly connected than an interference fit, such as a threaded joint. However, other types of removable, non-interference joinders can work. In addition, fastening member 110 can be a separate bolt means not coincident with an oil inlet port in body 9.

Deflector means 60 is shown in FIG. 1. Deflector means 60 includes a tubular member 120 rotatably mounted on rear wall 30 around outlet aperture 62. One means for mounting tubular member 120 includes a slot 122 positioned around a perimeter surface of tubular member 120. Slot 122 receives the edges of rear wall 30 that form the aperture 62 in a sliding relation, so that tubular member can be freely rotated to point tubular deflector member 120 in any direction. Insertion of rear wall 30 into slot 122 is facilitated by the fact that rear wall 30 and deflector 60 are provided from flexible, elastic plastic material. We prefer this material to be a plastic from the polyethylene family.

Finally, chamber 24 can be provided with a plurality of internal partitions 130, (FIG. 9) as by connecting rear wall portion 30 and front wall portion 32, for reinforcement and stiffness of shell 22. This divides shell 22 into a plurality of hollow, but interconnected exhaust chambers, with a variety of cross sections.

An unexpected benefit that derives from internal cavity 24 being of variable cross sectional shapes at different locations is that sound reduction is improved, and the tendency for freezing of exhaust fluid is reduced. An added benefit from the interference fit at top end 26 is that if freezing from exhaust completely closes aperture 46, the internal pressure increases to flexibly move contact surface 114 of shell 22 away from body 9, to permit exhaust to escape, thereby avoiding a potential explosive buildup of exhaust pressure.

Having described the invention, what is claimed is:

1. A muffler for a fluid-activated, percussive, impact apparatus comprising:

a. a hollow, elongated, shell forming a closed exhaust chamber, said shell adapted to extend lengthwise along a body portion of said apparatus and to partially encircle said apparatus body portion;

b. inlet means in said shell, for receiving percussive fluid exhausted from said apparatus;

c. outlet means in said shell for exhausting percussive fluid;

d. means for removably attaching said shell to said apparatus body;

e. said shell further comprising:

(i) a top portion and a bottom portion;

(ii) a rear wall portion spaced from said apparatus body;

(iii) a front wall portion positioned between said rear wall portion and said apparatus body, said front wall portion adapted to extend adjacent to said apparatus body portion; and (iv) intermediate wall portions connecting said front and rear wall portions;

f. said means for removably detaching said shell to said body comprising:

(i) a first attachment means on said top portion for removably connecting said top portion of said shell to a top portion of said apparatus body;

(ii) a second attachment means on said bottom portion for removably connecting said bottom portion of said shell to a bottom portion of said apparatus body; and (iii) a third attachment means intermediate said first and second attachment means, for removably connecting said shell to said apparatus body;

g. said first and second attachment means further comprising:

(i) said first attachment means being a flexible interference fit with a top portion of said apparatus body; and (ii) said second attachment means being a flexible interference fit with a bottom portion of said apparatus body;

h. said inlet means including an aperture located in said front wall portion at a position that coincides with an exhaust aperture on said apparatus body and said outlet means including an outlet aperture located in said rear wall portion;

i. said shell including a deflector means on said outlet means for directing percussive fluid exhausting out said outlet aperture; and j. said deflector means being movable, for directing percussive fluid in various directions.

2. The muffler of claim 1 herein said deflector means includes a tubular deflector member rotatably mounted on said rear wall, positioned around said outlet aperture.

3. A muffler for a percussive, fluid-activated, impact apparatus having a body with a backhead at a top end, a front head at a bottom end and an elongated body housing therebetween, said housing forming a central bore having a longitudinal central axis of piston reciprocation therethrough, said housing having an exhaust port for percussive fluid exhausted during a stroke cycle, said muffler comprising:

a. a hollow shell forming a closed exhaust chamber having a top portion and a bottom portion, said shell adapted to extend lengthwise along a portion of said body housing, said shell having a rear wall portion spaced from said body housing, a front wall portion between said rear wall portion and said body housing, said front wall portion formed to extend adjacent said body housing and encircle at least a portion of said body housing, and intermediate wall portions connecting said front and rear wall portions;

b. inlet means in said front wall portion for sealingly connecting to said exhaust port, to permit entry into said chamber of exhaust percussive fluid;

c. outlet means in said shell for exhausting said percussive fluid;

d. movable deflector means on said outlet means for directing said exhausted percussive fluid in various directions;

e. first flexible attachment means on a top portion of said shell for interference fit connection to said backhead;

f. second flexible attachment means on a bottom portion of said shell for interference fit connection to said fronthead; and g. threadable connection means for threadable connecting said shell to said housing.

4. The muffler of claim 3 wherein said front wall portion extends around said body housing through an arc from 180 to 270 degrees, as measured around said longitudinal axis of reciprocation.

5. The muffler of claim 4 wherein said shell includes at least one internal partition, whereby said chamber is divided into at least two hollow chambers.

6. A muffler for a fluid-activated, percussive, impact apparatus comprising:

a. a hollow, elongated, shell forming a closed exhaust chamber, said shell adapted to extend lengthwise along a body portion of said apparatus and to partially encircle said apparatus body portion;

b. said shell further comprising:

i. a top portion and a bottom portion;

ii. a front wall portion curved to form an elongated slot for partially encircling said apparatus body portion;

iii. a rear wall portion spaced from said front wall portion;

iv. intermediate wall portions connecting said front and rear wall portions; and v. said top, bottom, front, rear and intermediate wall portions being joined into a monolithic member forming said closed chamber;

c. inlet means in said front wall portion, for passing percussive fluid exhausted from said apparatus into said chamber;

c. outlet means in said rear wall portion for exhausting percussive fluid from said chamber; and d. means for removably attaching said shell to said apparatus body in at least one flexible, interference fit with said apparatus body and at least one noninterference, mechanical contact fit with said body portion.

7. The invention of claim 6 in which said means for removably detaching said shell to said body comprises:

a. a first attachment means on said top portion for removably connecting said top portion of said shell to a top portion of said apparatus body;

b. a second attachment means on said bottom portion for removably connecting said bottom portion of said shell to a bottom portion of said apparatus body; and c. a third attachment means intermediate said first and second attachment means, for removably connecting said shell to said apparatus body.

8. The muffler of claim 7 further comprising:

a. said first attachment means being a flexible interference fit with a top portion of said apparatus body; and b. said second attachment means being a flexible interference fit with a bottom portion of said apparatus body.

9. The muffler of claim 8 wherein said inlet means includes an aperture located in said front wall portion at a position that coincides with an exhaust aperture on said apparatus body and said outlet means includes an outlet aperture located in said rear wall portion.

10. The muffler of claim 9 wherein said shell includes a deflector means on said outlet means for directing percussive fluid exhausting out said outlet aperture.

11. The muffler of claim 9 wherein said front wall portion encircles said apparatus body over an arc of at least 180 degrees.

12. The muffler of claim 9 wherein said third attachment means extends through both said front wall portion and said rear wall portion, and includes a fastening member removably connected to said apparatus body, said fastening member contacting said rear surface of said shell, to force said shell against said apparatus body.

13. The muffler of claim 12 wherein said third attachment means includes a fluid passageway extending through said shell, positioned to coincide with a port for feeding liquid lubrication into said body, and said fastening member being a removable hollow plug extending into said passageway, said plug adapted to be removably threaded into said apparatus body.

14. The muffler of claim 13 wherein said hollow plug includes a removable closure cap.

* * * * *